US008568651B2

(12) United States Patent
MacKenzie et al.

(10) Patent No.: US 8,568,651 B2
(45) **Date of Patent: *Oct. 29, 2013**

(54) MIXER FOR A GAS CUTTING TORCH

(75) Inventors: Darrin MacKenzie, Golling, VT (US); Chris Conway, Wilmot, NH (US); Mike Wolfinger, Newbury, NH (US); Brandon Hebert, Williamstown, VT (US)

(73) Assignee: Victor Equipment Company, Denton, TX (US)

( * ) Notice: Subject to any disclaimer, the term of this patent is extended or adjusted under 35 U.S.C. 154(b) by 329 days.

This patent is subject to a terminal disclaimer.

(21) Appl. No.: 12/849,030

(22) Filed: Aug. 3, 2010

(65) Prior Publication Data

US 2012/0032002 A1 Feb. 9, 2012

(51) Int. Cl.
*B23K 7/00* (2006.01)

(52) U.S. Cl.
USPC ..... 266/48; 219/419

(58) Field of Classification Search
USPC ..... 266/48; 239/419
See application file for complete search history.

(56) References Cited

U.S. PATENT DOCUMENTS

| | | | | |
|---|---|---|---|---|
| 1,729,677 | A | | 10/1929 | Miller |
| 2,210,402 | A | | 8/1940 | Gaines |
| 2,373,309 | A | | 4/1945 | Hamilton |
| 2,484,891 | A | | 10/1949 | Jones |
| 3,364,970 | A | | 1/1968 | Dombruch et al. |
| 3,563,812 | A | | 2/1971 | Nakanishi et al. |
| 3,847,355 | A | * | 11/1974 | Smith ..... 239/424.5 |
| 3,948,496 | A | * | 4/1976 | Miller ..... 266/48 |
| 4,173,499 | A | | 11/1979 | Holemann |
| 4,455,176 | A | | 6/1984 | Fuhrhop |
| 4,541,798 | A | | 9/1985 | Miller et al. |
| 4,548,358 | A | | 10/1985 | Fischer |
| 4,854,857 | A | | 8/1989 | Houtman |
| 4,892,475 | A | | 1/1990 | Farrenkopf et al. |
| 5,000,426 | A | | 3/1991 | Campana et al. |
| 5,123,837 | A | | 6/1992 | Farnham et al. |
| 5,273,216 | A | | 12/1993 | Goulet et al. |
| 5,393,223 | A | | 2/1995 | Goerde et al. |
| 5,470,227 | A | | 11/1995 | Mims et al. |
| 5,540,585 | A | | 7/1996 | Coulcher et al. |
| 5,560,546 | A | | 10/1996 | Goulet et al. |
| 5,695,328 | A | | 12/1997 | DeFreitas et al. |
| 5,700,421 | A | | 12/1997 | Bissonnette |
| 5,792,281 | A | | 8/1998 | Diehl |
| 5,882,437 | A | | 3/1999 | Dixon et al. |
| 6,261,512 | B1 | | 7/2001 | Donze et al. |
| 6,277,323 | B1 | | 8/2001 | Bissonnette |

(Continued)

FOREIGN PATENT DOCUMENTS

| | | |
|---|---|---|
| GB | 975380 | 9/1961 |
| GB | 1207180 | 3/1967 |

(Continued)

*Primary Examiner* — Scott Kastler
(74) *Attorney, Agent, or Firm* — Brinks Hofer Gilson & Lione

(57) ABSTRACT

A tip assembly for use in a gas cutting torch is provided that includes a tip and a mixer. The tip includes a tip central gas passageway and a distal orifice and the mixer includes a proximal end portion and a distal end portion. The distal end portion of the mixer is adapted for connection to the tip and the proximal end portion of the mixer defines a connecting member that removably connects the mixer to a torch head.

22 Claims, 8 Drawing Sheets

(56) References Cited

U.S. PATENT DOCUMENTS

| | | | |
|---|---|---|---|
| 6,451,245 | B2 | 9/2002 | Pisot et al. |
| 6,805,832 | B2 | 10/2004 | Mohler et al. |
| 2007/0281263 | A1 | 12/2007 | Johnston et al. |
| 2008/0061482 | A1 | 3/2008 | Faust et al. |
| 2008/0171295 | A1 | 7/2008 | Yang |
| 2008/0248435 | A1 | 10/2008 | Clark et al. |
| 2012/0032001 | A1* | 2/2012 | MacKenzie et al. ..... 239/419 |

FOREIGN PATENT DOCUMENTS

| | | |
|---|---|---|
| JP | 2000121054 | 10/1998 |
| JP | 2000210768 | 1/1999 |
| WO | 9939833 | 8/1999 |
| WO | 2006095934 | 9/2006 |

* cited by examiner

MIXER FOR A GAS CUTTING TORCH

FIELD

The present disclosure relates generally to a gas cutting torch and more particularly to a tip assembly of a gas cutting torch having an improved mixer.

BACKGROUND

The statements in this section merely provide background information related to the present disclosure and may not constitute prior art.

Oxy-fuel cutting torches, or gas cutting torches, generally employ oxygen and a fuel gas, such as acetylene or propane, by way of example, to cut a workpiece. More specifically, preheat oxygen and the fuel gas are mixed and ignited to provide heat to the workpiece, and then additional oxygen, commonly referred to as cutting oxygen, is added to react with the heated workpiece. This reaction of the cutting oxygen with the heated workpiece initiates sufficient heat and momentum of the gases to initiate a cutting process.

The cutting torch may be a premixed or a postmixed type torch. In a premixed torch, preheat oxygen and fuel gas are mixed within the torch head before being discharged for ignition. In a postmixed cutting torch, the preheat oxygen and fuel gas are discharged from the torch in unmixed streams. Turbulence in the discharged streams mixes the oxygen and fuel gas before ignition occurs. An advantage of the postmixed cutting torch is that postmixed cutting tips produce a longer heat zone than premixed tips, which permits the postmixed torches to operate farther from the work, decreasing the heat stress on the torch and increasing the service life of the tip.

With their inherent drawbacks, improved designs are desired in the field of premixed gas cutting torches. Moreover, ways in which to increase the lifetime of the premixed tip and provide a more compact tip design and thus reduce costs are also desirable.

SUMMARY

In one form, the present disclosure generally provides a tip assembly for use in a gas torch comprising a tip and a mixer. The tip has a tip central gas passageway and a distal orifice and the mixer has a proximal end portion and a distal end portion. The distal end portion of the mixer is adapted for connection to the tip and the proximal end portion of the mixer defines a connecting member that removably connects the mixer to a torch head.

In another form of the present disclosure, a gas torch is provided that comprises a torch head and a tip assembly secured to the torch head. The tip assembly includes a tip having an outer tip portion defining a central cavity and a distal orifice and an inner tip portion disposed within the central cavity of the outer tip portion. The inner tip portion defines an outer surface, a tip central gas passageway in communication with the distal orifice of the outer tip portion, and at least one intermediate gas passageway extending from the outer surface to the tip central gas passageway for a flow of at least one gas to provide improved cooling to the tip. A mixer is secured to the tip and the torch head and includes a proximal end portion and a distal end portion. The distal end portion of the mixer is adapted for connection to the tip and the proximal end portion of the mixer defines a connecting member that removably connects the mixer to the torch head. A locking ring connects the tip and the mixer to the torch head.

In yet another form of the present disclosure, a gas torch is provided that comprises a torch head and a mixer having a proximal end portion and a distal end portion. The distal end portion of the mixer is adapted for connection to a tip and the proximal end portion defines a connecting member that removably connects the mixer to the torch head.

In still another form, the present disclosure provides a method of cooling a tip of a tip assembly of a gas torch. The tip assembly includes a mixer connected to the tip and the tip and the mixer are secured to a torch head of the gas torch. The method comprises directing a flow of a first gas and a flow of a second gas to a mixer central gas passageway of the mixer; directing the flow of the mixed first and second gases from the mixer to an axial passageway of the tip; directing a flow of a third gas to an outer passageway of the tip; directing the flow of the third gas inwardly through at least one intermediate gas passageway; directing the flow of the third gas to a tip central gas passageway of the inner tip; and directing the flow of the mixed first and second gases and the flow of the third gas distally through a distal portion of the tip.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1*a* is a partial cross-sectional view of a typical tip of a gas torch known in the art;

FIG. 1*b* is a perspective view of the tip of FIG. 1*a;*

FIG. 2 is a perspective view of a gas cutting torch constructed in accordance with the principles of the present disclosure;

FIG. 3*a* is a partial cross-sectional view of one form of a tip for use in a gas torch constructed in accordance with the principles of the present disclosure;

FIG. 3*b* is an alternate partial cross-sectional view of the tip of FIG. 3*a;*

FIG. 4 is cross-sectional view of another form of a tip for use in a gas torch, taken along a line through the intermediate passageways of the inner tip portion of the tip;

FIG. 5*a* is a partial cross-sectional view of another form of a tip for use in a gas torch constructed in accordance with further principles of the present disclosure;

FIG. 5*b* is a perspective view of the tip of FIG. 5*a;*

Figure 6:
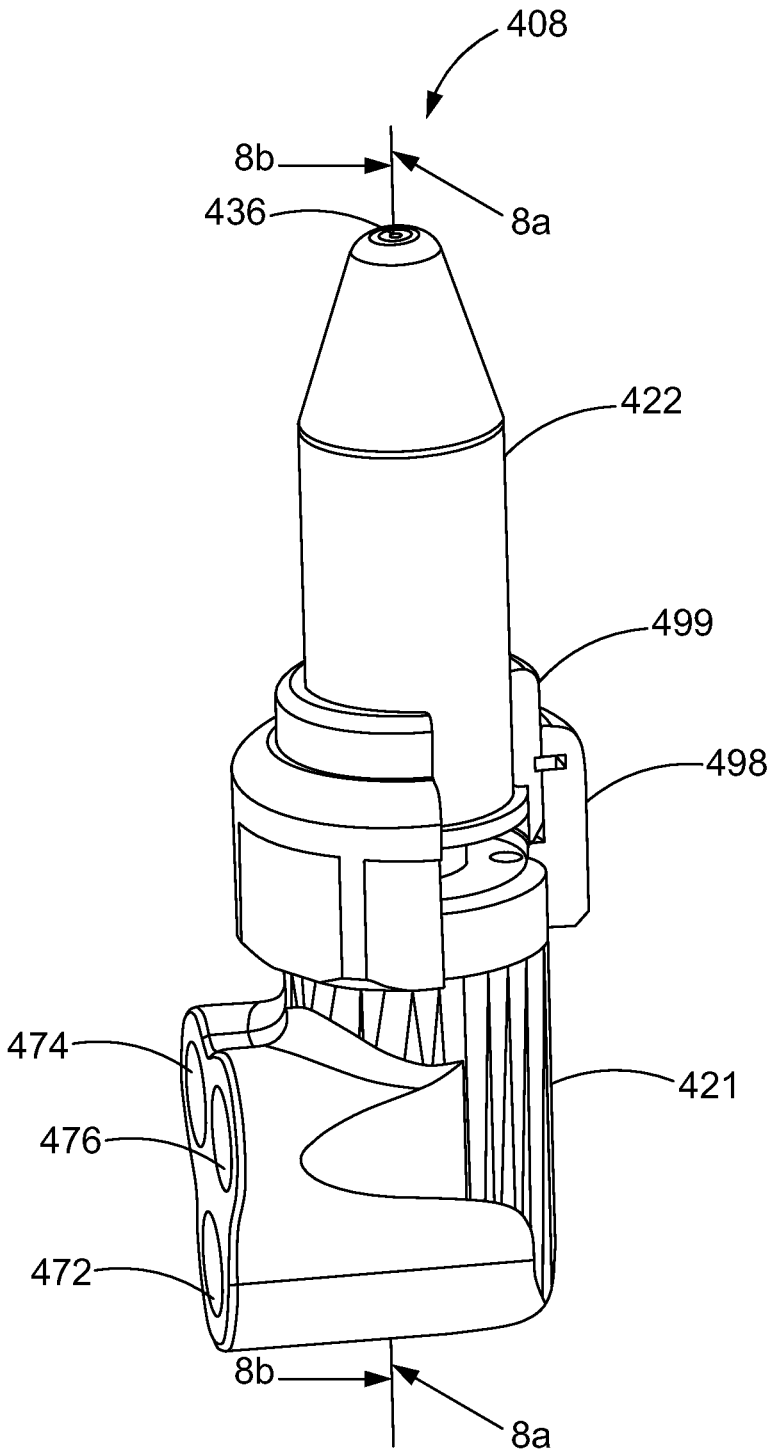
FIG. 6 is a perspective view of a tip assembly for use in a gas torch constructed in accordance with the principles of the present disclosure.
Figure 8A:
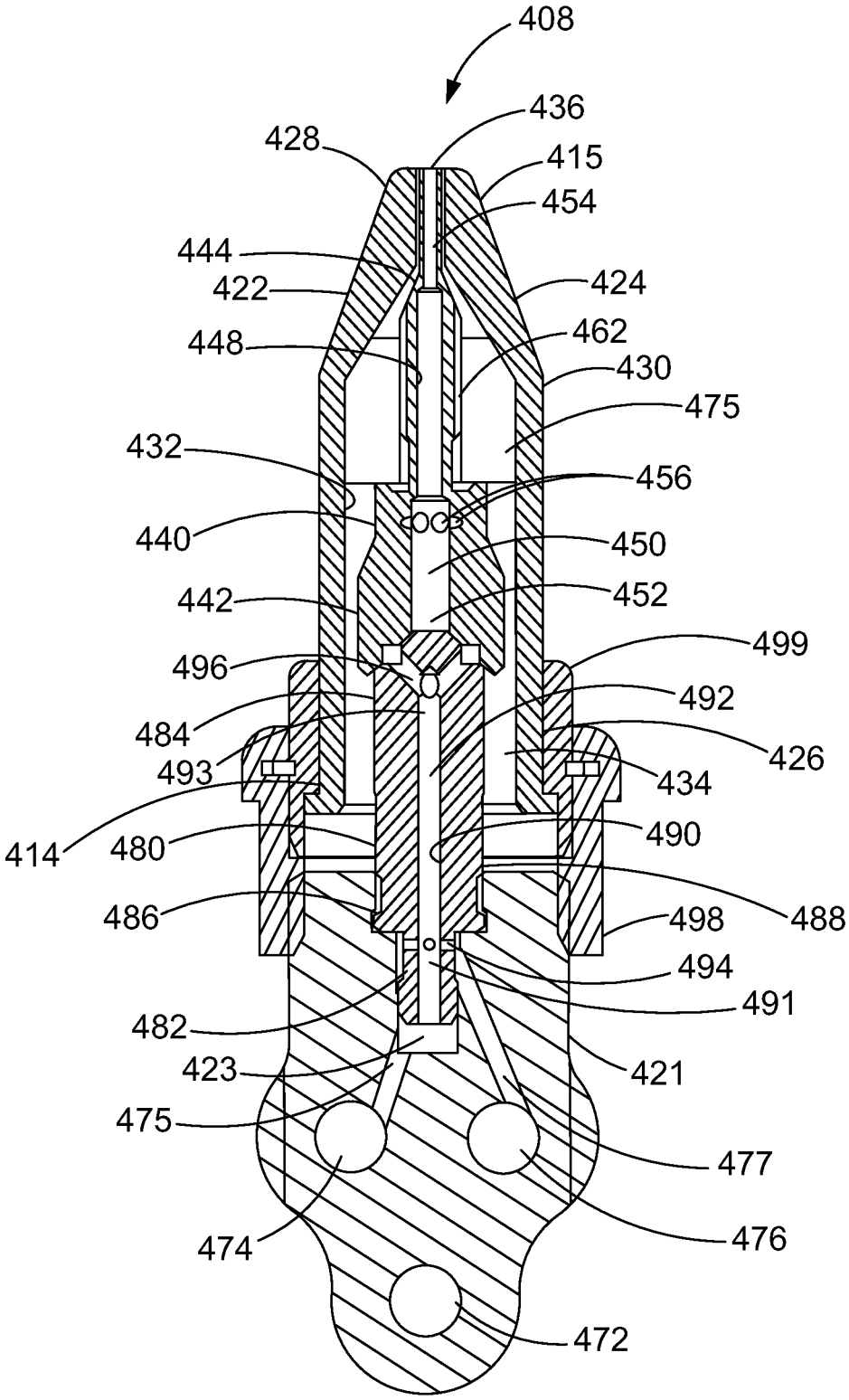
Figure 8B:
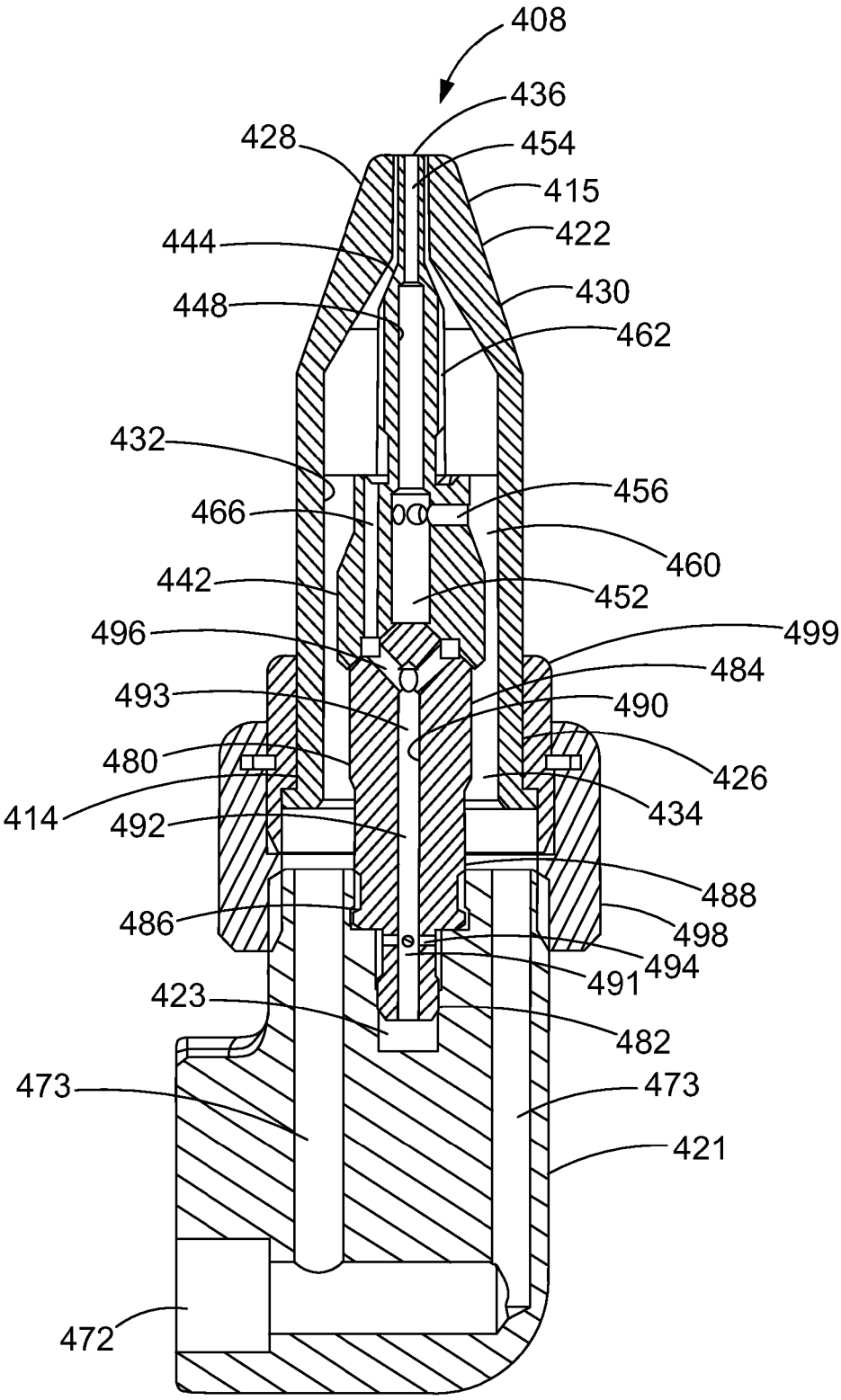

FIG. 8*a* is a partial cross-sectional view of the tip assembly of FIG. 6 taken along line 8*a*-8*a*; and FIG. 8*b* is a partial cross-sectional view of the tip assembly of FIG. 6 taken along line 8*b*-8*b*.

DETAILED DESCRIPTION

The following description is merely exemplary in nature and is in no way intended to limit the present disclosure, its application, or uses. It should be understood that throughout the description and drawings, corresponding reference numerals indicate like or corresponding parts and features.

Figure 1A:
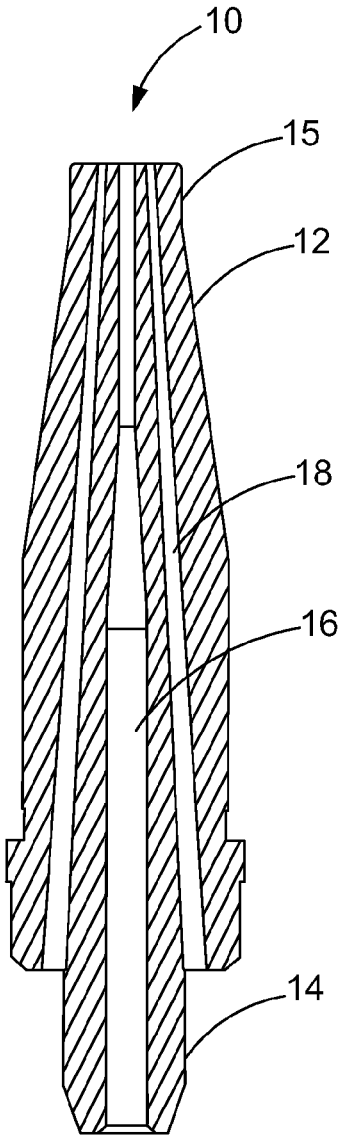
Fig. 1a (prior art)
Figure 1B:
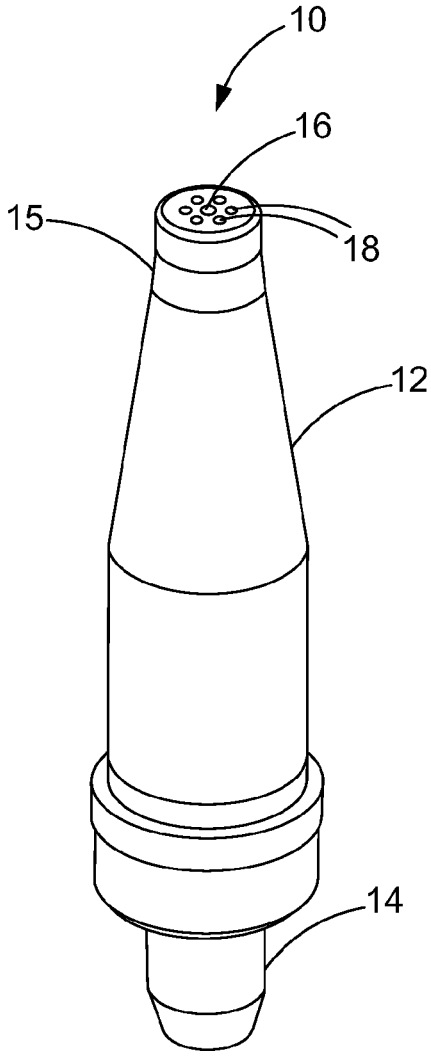
Fig. 1b (prior art)

Referring to FIGS. 1*a-b*, a typical tip for use with a gas cutting torch is illustrated and generally indicated by reference numeral 10. The tip 10 comprises a body 12 having a proximal end portion 14 which attaches to a torch head of the gas cutting torch (not shown) and a distal end portion 15 through which the gas exits to perform the cutting operation. The body 12 defines a central gas passageway 16 for the flow of cutting oxygen and a plurality of axial passageways 18 for the flow of preheat gas, e.g., premixed oxygen and fuel gas. Thus, cutting oxygen flows from a passage within the torch head of the gas cutting torch straight through the center, or central passageway 16, of the tip 10. Tips 10 having the traditional straight-through design are easy to manufacture, however, they are not designed for optimal cooling of the tip 10.

Figure 2:
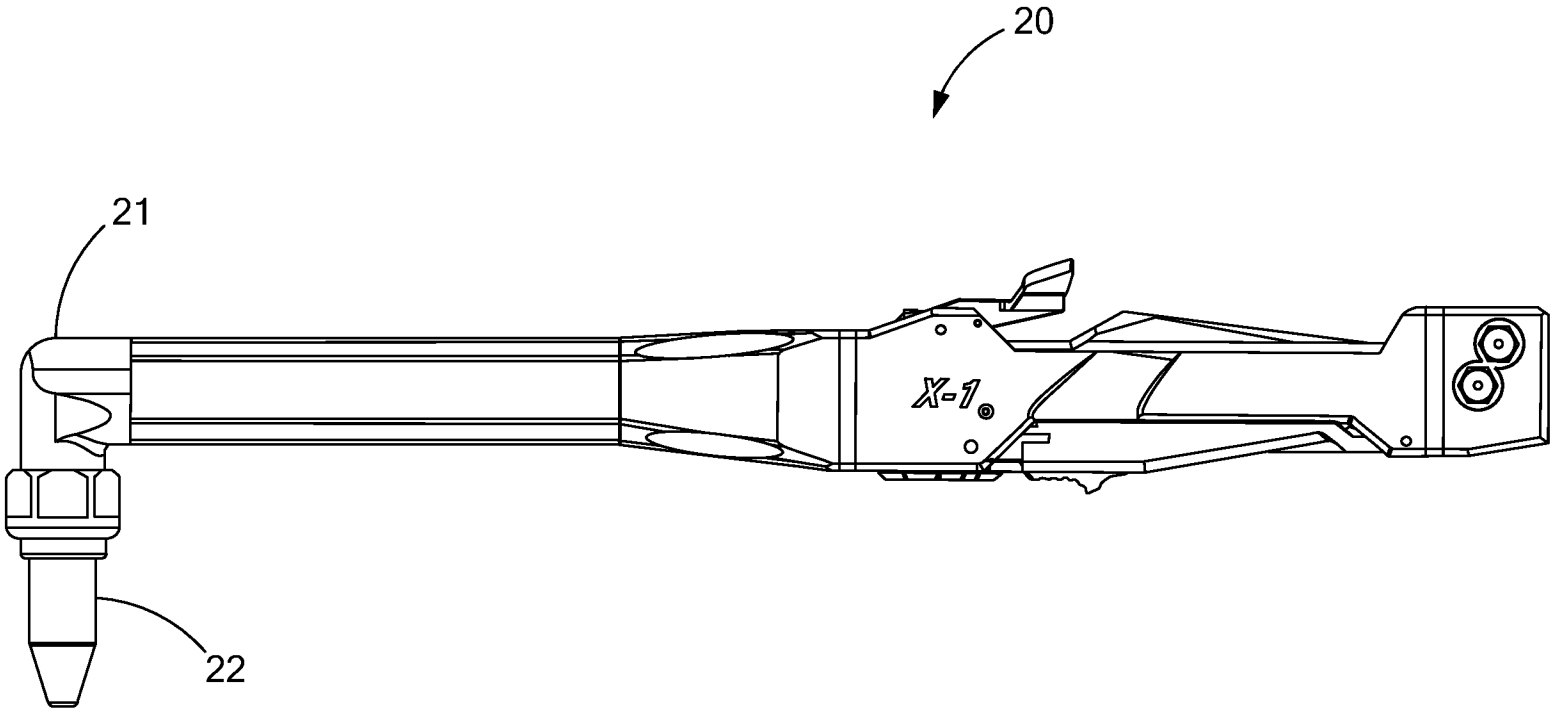

Various forms of an improved tip for use with a gas cutting torch designed for enhanced cooling are disclosed herein and in U.S. patent application entitled, "Gas Cutting Tip with Improved Flow Passage" to MacKenzie et al. (filed concurrently herewith under 12/849,028), the entire contents of which are incorporated by reference herein. Referring to FIG. 2, a gas cutting torch in accordance with the teachings of the present disclosure is illustrated and generally indicated by reference numeral 20. The gas cutting torch 20 includes a torch head 21 and a tip 22 secured to the torch head 21, the tip 22 having an improved flow passage designed for enhanced cooling, various forms of which are described in further detail below and indicated by corresponding reference numerals increased by increments of 100.

Figure 3A:
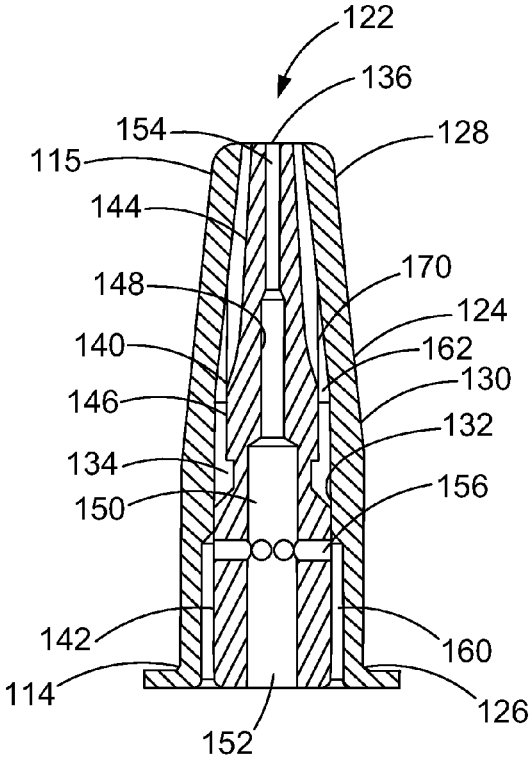
Figure 3B:
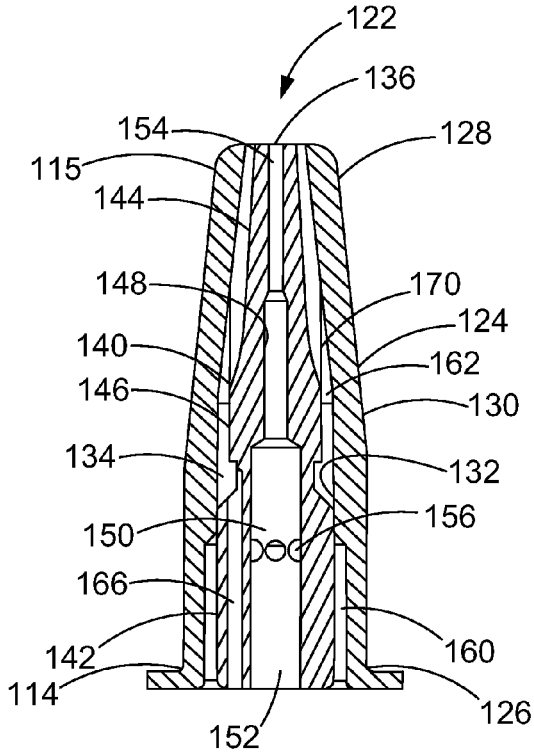

FIGS. 3*a-b* illustrate one form of a tip 122 in accordance with the teachings of the present disclosure. The tip 122 includes a proximal end portion 114 which attaches to the torch head 21 of the gas cutting torch 20 and a distal end portion 115 through which the gas exits to perform the cutting operation. In this form, the tip 122 comprises an outer tip portion 124 having a proximal portion 126 and a distal portion 128. The outer tip portion 124 defines an outer surface 130 and an inner surface 132 and further defines a central cavity 134 and a distal orifice 136. An inner tip portion 140 is disposed within the central cavity 134 of the outer tip portion 124. In one form, the outer tip portion 124 and the inner tip portion 140 are separate components. In another form, the outer tip portion 124 and the inner tip portion 140 are unitarily formed as a single piece by any suitable means in the art, such as, e.g., lost-wax casting.

The inner tip portion 140 has a proximal portion 142 and a distal portion 144 and defines an outer surface 146 and an inner surface 148. The inner tip portion 140 further defines a central gas passageway 150 having a proximal end portion 152 generally occluded by a component of the gas cutting torch 20 extending to a distal end portion 154 in fluid communication with the distal orifice 136 of the outer tip portion 124. Additionally, the inner tip portion 140 defines at least one intermediate gas passageway 156 extending from the outer surface 146 of the inner tip portion 140 to the central gas passageway 150 for the flow of at least one gas to provide improved cooling to the tip 122, as described in further detail below. More specifically, in one form of the present disclosure, a plurality of intermediate gas passageways 156 extends between the outer surface 146 of the inner tip portion 140 and the central gas passageway 150.

As shown in FIGS. 3*a-b*, the tip 122 defines a proximal annular gas passageway 160 and a distal annular gas passageway 162. The proximal annular gas passageway 160 is disposed between the inner surface 132 of the proximal portion 126 of the outer tip portion 124 and the outer surface 146 of the proximal portion 142 of the inner tip portion 140. The distal annular gas passageway 162 is disposed between the inner surface 132 of the distal portion 128 of the outer tip portion 124 and the outer surface 146 of the distal portion 144 of the inner tip portion 140. In this form, the proximal and distal annular gas passageways 160, 162 are generally not in fluid communication with one another due to the size and configuration of the inner tip portion 140 within the central cavity 134 of the outer tip portion 124. As further illustrated in FIG. 3*b*, the inner tip portion 140 defines at least one offset axial passageway 166 that extends from within the proximal portion 142 of the inner tip portion 140 to the distal annular gas passageway 162.

The tip 122 is attached to the torch head 21 of the gas cutting torch 20 by any suitable means known or contemplated in the art. For example, the torch head 21 may have external threads for receiving a threaded tip nut for connecting the tip 122 to the torch head 21. Alternatively, in another form of the present disclosure, a tip seat may be secured to the torch head 21 and the tip 122 secured to the tip seat by way of a locking nut. The gas cutting torch 20 generally includes a plurality of internal gas supply tubes for the flow of preheat oxygen, fuel gas, and cutting oxygen and the torch head 21 generally includes a plurality of passages in fluid communication with the gas supply tubes and through which the preheat oxygen, fuel gas, and cutting oxygen flow and enter the tip 122.

Figure 7:
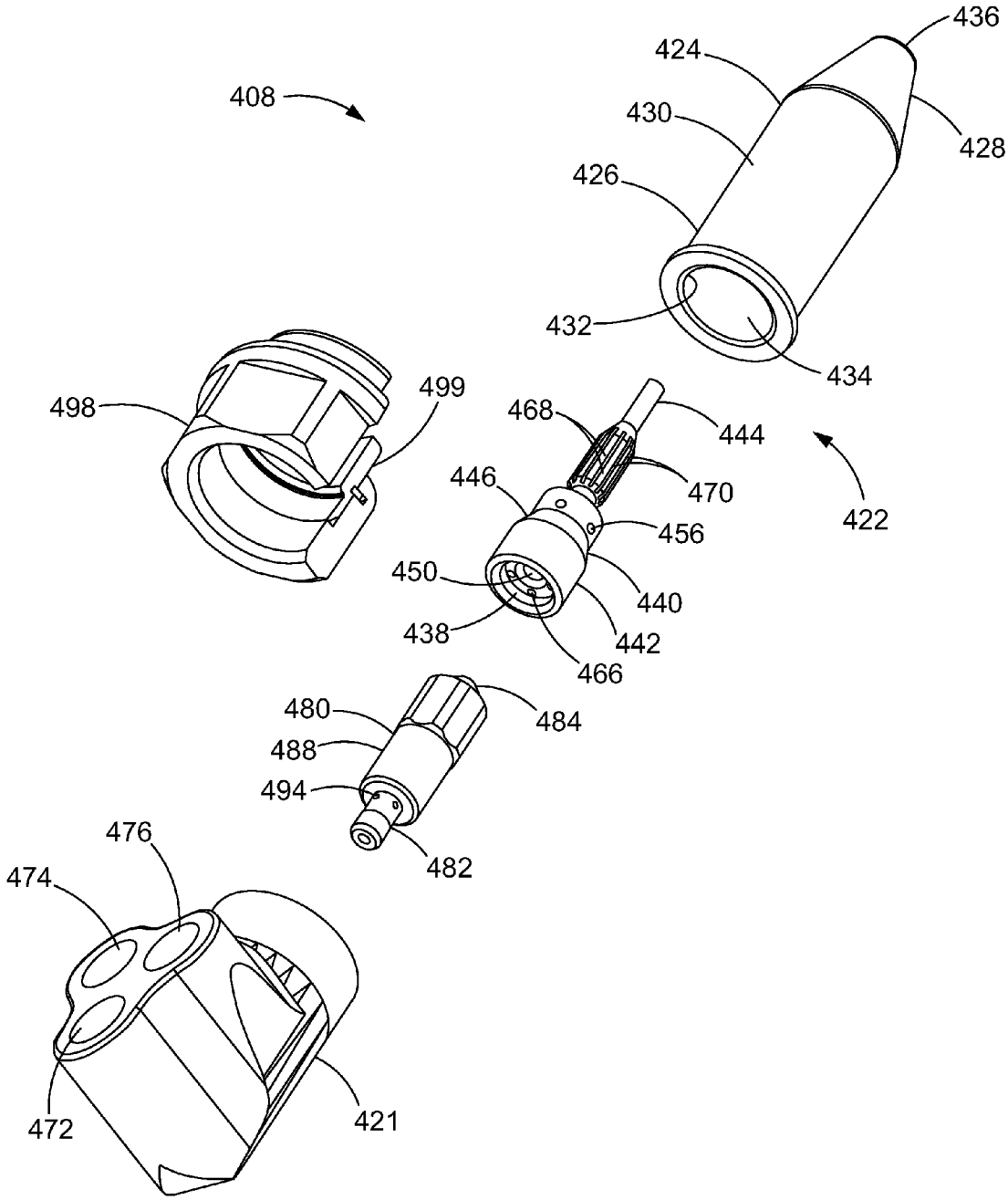
FIG. 7 is an exploded view of the tip assembly of FIG. 6.

In operation, preheat gas, e.g., mixed preheat oxygen and fuel gas (i.e., acetylene, propane, liquid petroleum, or natural gas) flows from a passage within the torch head 21 (or from a mixer, as discussed in further detail with respect to FIGS. 6-8) into the axial passageway 166 within the inner tip portion 140 of the tip 422. The preheat gas flows through the axial passageway 166 into the distal annular gas passageway 162 and exits the distal portion 115 of the tip 122. In this form, the proximal portion 152 of the central gas passageway 150 is occluded by a component of the gas cutting torch 20 (e.g., a mixer, as discussed in further detail with respect to FIGS. 6-8).

Accordingly, cutting oxygen does not flow from the torch head 21 straight through the central passageway 150 of the tip 122 as in the traditional tip 10 of FIGS. 1*a-b*. Rather, cutting oxygen flows from a passage within the torch head 21 into the proximal annular gas passageway 160 and from the proximal annular gas passageway 160 into the central gas passageway 150 via the intermediate gas passageways 156. The cutting oxygen thus flows in between the inner and outer tip portions 140, 124 before entering the central gas passageway 150 via the intermediate passageways 156. The geometry of the cutting oxygen flow passage, i.e., the extra surface area of the inner and outer tip portions 140, 124 in contact with the cutting oxygen, results in an enhanced cooling effect. The enhanced cooling not only prolongs the lifetime of the consumable tip 122, but allows for a smaller tip 122, resulting in a more compact design due to the reduced distance between the distal orifice 136 and the point of entry of the cutting oxygen (i.e., the proximal end portion 114 of the tip 422).

Figure 4:
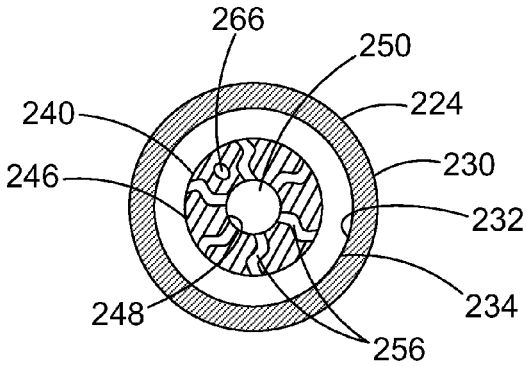

In FIG. 3*a*, the intermediate passageways 156 extend radially between the outer surface 146 of the inner tip portion 140 and the central gas passageway 150. Alternatively, the intermediate passageways 156 may extend at an angle between the outer surface 146 of the inner tip portion 140 and the central gas passageway 150. In another form of the present disclosure, as illustrated in FIG. 4, the intermediate passageways 256 define a swirl configuration between the outer surface 246 of the inner tip portion 240 and the central gas passageway 250.

In one form, the inner tip portion 140 includes at least one raised ridge or rib 170 extending along at least a portion of the outer surface 146 of the inner tip portion 140 and at least one flute disposed adjacent the rib 170. FIG. 7 best illustrates an inner tip portion 440 of a tip 422 having a plurality of ribs 470 and flutes 468 extending along the outer surface 446 thereof to provide cooling as the gas passes through the flutes 468. Alternatively, or in combination, the tip 122 may include at least one rib and at least one flute extending along at least a portion of the inner surface 132 of the outer tip portion 124. Additionally, the tip 122 may include a dielectric spacer disposed between the outer tip portion 124 and the inner tip portion 140. The dielectric spacer may include at least one rib and at least one flute extending along at least a portion of the inner surface of the dielectric spacer proximate the inner tip portion.

Further, the inner tip portion 140 is conductive and is adapted for electrical connection to an ignition system of the gas torch 20. An ignition wire (not shown) from an ignition system extends through the tip 122 and is in electrical contact with the conductive inner tip portion 140 and thus generates the spark for ignition of the gas cutting torch 20.

Figure 5A:
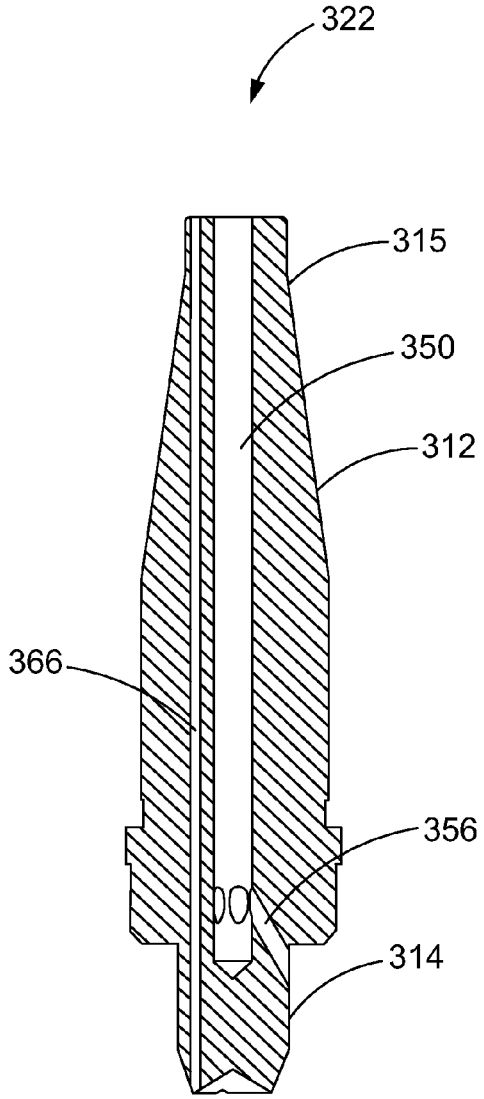
Figure 5B:
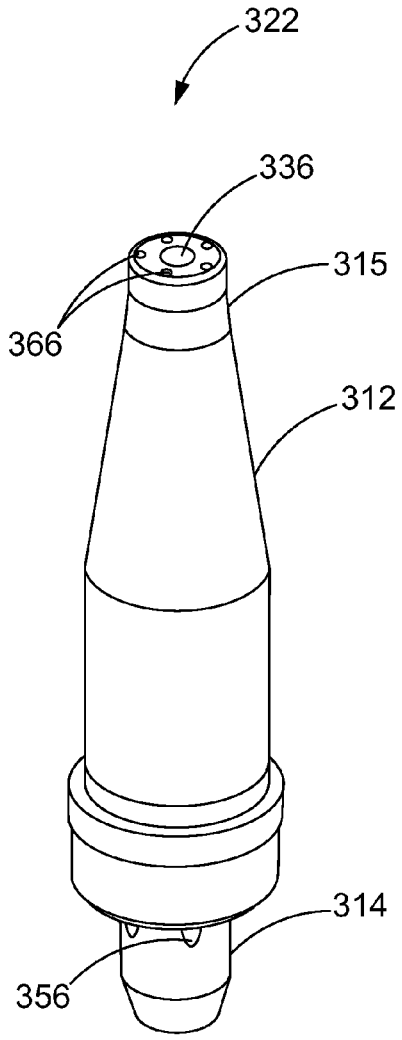

Referring to FIGS. 5*a-b*, another form of a tip for use with a gas cutting torch 20 in accordance with further teachings of the present disclosure is illustrated and generally indicated by reference numeral 322. The tip 322 generally comprises a body 312 having a proximal end portion 314 which attaches to the torch head 21 and a distal end portion 315 through which the gas exits to perform the cutting operation. In this form, the body 312 defines at least one axial passageway 366 extending from the proximal end portion 314 to the distal end portion 315 for the flow of preheat gas and a central gas passageway 350 for the flow of cutting oxygen. Additionally, the body 312 defines at least one intermediate gas passageway 356 extending at an angle between the outer surface of the body 312 and the central gas passageway 350 for the flow of at least one gas to provide improved cooling to the tip 322. As shown in FIG. 5*a*, the central gas passageway 350 is occluded near the proximal end portion 314 of the tip 322.

In operation, the axial passageway 366 receives preheat gas from a passage in the torch head 21. The central gas passageway 350 receives cutting oxygen via the intermediate gas passageways 356 in fluid communication with a cutting oxygen passage within the torch head 21. Similar to the tip 122 of FIGS. 3*a-b*, the geometry of the cutting oxygen flow passage of the tip 322 provides enhanced cooling as a result of the extra surface area (i.e., the intermediate gas passageways 356) in contact with the cutting oxygen.

Referring now to FIGS. 6, 7, and 8*a-b*, a tip assembly for use with a gas cutting torch in accordance with further teachings of the present disclosure is illustrated and generally indicated by reference numeral 408. The tip assembly 408 comprises a tip 422 having a proximal end portion 414 which attaches to a torch head 421 and a distal end portion 415 through which gas exits to perform the cutting operation. The tip assembly 408 further comprises a mixer 480 attached to the proximal end portion 414 of the tip 422 and the torch head 421.

The tip 422 includes an outer tip portion 424 having a proximal portion 426 and a distal portion 428. The outer tip portion 424 defines an outer surface 430 and an inner surface 432 and further defines a central cavity 434 and a distal orifice 436. An inner tip portion 440 is disposed within the central cavity 434 of the outer tip portion 424. In FIG. 7, the outer tip portion 424 and the inner tip portion 440 are separate components. However, the outer tip portion 424 and the inner tip portion 440 may be unitarily formed as a single piece by any suitable means in the art, such as, e.g., lost-wax casting.

The inner tip portion 440 has a proximal portion 442 and a distal portion 444 and defines an outer surface 446 and an inner surface 448. The inner tip portion 440 defines a central gas passageway 450 having a proximal portion 452 generally occluded by a component of the gas cutting torch, i.e., the mixer 480, as described in further detail below. The central gas passageway 450 extends from the proximal portion 452 to a distal portion 454 in fluid communication with the distal orifice 436 of the outer tip portion 424. Additionally, the inner tip portion 440 defines at least one intermediate gas passageway 456 extending from the outer surface 446 of the inner tip portion 440 to the central gas passageway 450 for the flow of at least one gas to provide improved cooling to the tip 422, as described in further detail below.

As best illustrated in FIGS. 8*a-b*, the tip 422 includes a proximal annular gas passageway 460 and a distal annular gas passageway 462. The proximal annular gas passageway 460 is disposed between the inner surface 432 of the proximal portion 426 of the outer tip portion 424 and the outer surface 446 of the proximal portion 442 of the inner tip portion 440. The distal annular gas passageway 462 is disposed between the inner surface 432 of the distal portion 428 of the outer tip portion 424 and the outer surface 446 of the distal portion 444 of the inner tip portion 440. As further illustrated in FIG. 8*b*, the inner tip portion 440 defines at least one offset axial passageway 466 that extends from within the proximal portion 442 of the inner tip portion 440 to the distal annular gas passageway 462.

The tip assembly 408 further includes a mixer 480 for mixing preheat oxygen and fuel gas to form a preheat gas mixture. As illustrated in FIGS. 8*a-b*, the mixer 480 includes a proximal end portion 482 adapted for removable connection to the torch head 421 and a distal end portion 484 adapted for connection to the tip 422. In this form, the distal end portion 484 of the mixer 480 matingly fits within a proximal recess 438 of the inner tip portion 440. The distal end portion 484 of the mixer 480 thus occludes the proximal portion 452 of the central gas passageway 450 of the inner tip portion 440. The proximal portion 482 of the mixer 480 defines a connecting member 486 for removably connecting the mixer 480 to the torch head 421. As best illustrated in FIGS. 8*a-b*, the connecting member 486 includes a detent that engages a recess formed within the torch head 421. The connecting member 486 may alternatively include threads or any other suitable connection means known or contemplated in the art for removably connecting the mixer 480 to the torch head 421.

The mixer 480 defines an outer surface 488 and an inner surface 490 and a plurality of internal gas passageways, including a central gas passageway 492, a plurality of proximal gas passageways 494, and a plurality of distal gas passageways 496. In this form, the central gas passageway 492 extends from a proximal end 491 at the proximal end portion 482 of the mixer 480 to a distal end 493 proximate the distal end portion 484 of the mixer. The plurality of proximal gas passageways 494 extend from the outer surface 488 of the proximal end portion 482 of the mixer 480 to the central gas passageway 492. In FIGS. 8*a-b*, the proximal gas passageways 494 extend radially between the outer surface 488 of the mixer 480 and the central gas passageway 492. In another form, the proximal gas passageways 494 may extend at an angle between the outer surface 488 of the mixer 480 and the central gas passageway 492 or in a spiral configuration similar to the intermediate passageways of the tip of FIGS. 5*a-b* and 4, respectively.

The plurality of distal gas passageways 496 extend from the distal end 493 of the central gas passageway 492 to the outer surface 488 of the distal end portion 484 of the mixer 480. In this form, the distal gas passageways 496 extend at an angle between the central gas passageway 492 and the outer surface 488 of the distal end portion 484 of the mixer 480.

As illustrated in FIGS. 6-8, the tip assembly 408 further comprises a locking ring 498 for connecting the tip 422 and the mixer 480 to the torch head 421 and a spacer 499 disposed between the locking ring 498 and the outer surface 430 of the proximal portion 426 of the outer tip portion 424.

The torch head 421 generally includes a plurality of passages in fluid communication with gas supply tubes within the gas cutting torch 20. As illustrated in FIGS. 8*a-b*, the torch head 421 includes a cutting oxygen inlet bore 472, a preheat oxygen inlet bore 474, and a fuel gas inlet bore 476 for receiving cutting oxygen, preheat oxygen, and fuel gas from respective supply tubes within the gas cutting torch 20. The torch head 421 defines at least one cutting oxygen passage 473 extending from the cutting oxygen inlet bore 472, a preheat oxygen passage 475 extending from the preheat oxygen inlet bore 474, and a fuel gas passage 477 extending from the fuel gas inlet bore 476. It is noted that the positioning of the preheat oxygen inlet bore 474 and corresponding preheat oxygen passage 475 and the fuel gas inlet bore 476 and corresponding fuel gas passage 477 may be switched, i.e., reference numerals 474, 475 and 476, 477 may designate either the preheat oxygen inlet bore and passage or the fuel gas inlet bore and passage.

The tip 422 and the mixer 480 are connected to the torch head 421 such that the cutting oxygen passage 473 and the proximal annular passageway 460 of the tip 422 are in fluid communication; and such that one of the preheat oxygen passage 475 and the fuel gas passage 477 is in fluid communication with the central passageway 492 of the mixer 480 and the other one of the preheat oxygen passage 475 and the fuel gas passage 477 is in fluid communication with the proximal gas passageways 494 of the mixer. In FIG. 8*a*, the preheat oxygen passage 475 and the central gas passageway 492 of the mixer 480 are in fluid communication via the recess 423 formed within the torch head 421, and the fuel gas passage 477 and the proximal gas passageways 494 of the mixer 480 are in fluid communication.

In operation, preheat oxygen and fuel gas (i.e., acetylene, propane, liquid petroleum, or natural gas) are mixed within the mixer 480 to form preheat gas. More specifically, preheat oxygen flows from an internal preheat oxygen supply tube within the gas torch 20 into the preheat oxygen passage 475 via the preheat oxygen inlet bore 474. The preheat oxygen flows through the preheat oxygen passage 475 and the recess 423 formed within the torch head 421 and enters the proximal end 491 of the central gas passageway 492 of the mixer 480. The fuel gas flows from an internal fuel gas supply tube within the gas torch 20 into the fuel gas passage 477 via the fuel gas inlet bore 476. The fuel gas flows through the fuel gas passage 477 within the torch head 421 and enters the central gas passageway 492 of the mixer 480 via the plurality of proximal gas passageways 494. The preheat oxygen and the fuel gas mix within the mixer 480 as they flow together through the central gas passageway 492. The mixed preheat gas then flows from the mixer 480 to the at least one axial gas passageway 466 via the angled distal gas passageways 496. The preheat gas flows through the axial passageway 466 into the distal annular gas passageway 462 and exits the distal portion 415 of the tip 422 for the discharge of preheat gas from the torch.

Additionally, cutting oxygen flows from an internal cutting oxygen supply tube within the gas torch 20 into the cutting oxygen passage 473 via the cutting oxygen inlet bore 472. As illustrated in FIGS. 8*a-b*, the proximal portion 452 of the central gas passageway 450 of the inner tip portion 440 of the tip 422 is occluded by the distal end portion 484 of the mixer 480. Accordingly, cutting oxygen does not flow from the torch head 421 straight through the central gas passageway 450 of the tip 422 as in the traditional tip 10 of FIGS. 1*a-b*. Rather, cutting oxygen flows from the cutting oxygen passage 473 within the torch head 421 into the proximal annular gas passageway 460 of the tip 422 and from the proximal annular gas passageway 460 into the central gas passageway 450 via the intermediate gas passageways 456. The cutting oxygen thus flows in between the inner and outer tip portions 440, 424 before entering the central gas passageway 450 via the intermediate passageways 456. The cutting oxygen then flows distally through the central gas passageway 450 and exits the distal portion 415 of the tip 422 via the distal orifice 436 for the discharge of cutting oxygen from the gas torch 20.

Accordingly, FIGS. 6, 7, and 8*a-b* illustrate a tip assembly 408 including a consumable tip 422 having an improved flow passage geometry for enhanced cooling of the tip 422 due to the extra surface area of the inner and outer tip portions 440, 424 in contact with the cutting oxygen. The enhanced cooling not only prolongs the lifetime of the consumable tip 422, but allows for a smaller tip 422, resulting in a more compact design due to the reduced distance between the distal orifice 436 and the point of entry of the cutting oxygen (i.e., the proximal end portion 414 of the tip 422). More specifically, a tip having a traditional flow passage similar to that shown in FIGS. 1*a-b* typically has a length of about 2.5 inches whereas a tip 422 having an improved flow passage in accordance with the teachings of the present disclosure, in one example, has a length of about 1.5 inches. With a reduction in tip size follows a reduction in material, e.g., copper, and thus a reduction in cost.

Additionally, the mixer 480 of the tip assembly 408 defines a distended length and allows for a tip 422 having a reduced length. Thus, the mixer 480 and the tip 422 having an improved flow passage provide a premixed tip having a more compact design. Further, the enhanced cooling effect of the improved flow passage of the premixed tip 422 of the present disclosure has a similar effect as the longer heat zone in postmixed tips, i.e., decreases the heat stress on the torch and increases the life of the consumable tip.

The present disclosure is merely exemplary in nature and, thus, variations that do not depart from the gist of the disclosure are intended to be within the scope of the present disclosure. Such variations are not to be regarded as a departure from the spirit and scope of the present disclosure.

The invention claimed is:

1. A tip assembly for use in a gas torch comprising:

a tip having a tip central gas passageway and a distal orifice;

a mixer having a proximal end portion and a distal end portion, the distal end portion of the mixer being adapted for connection to the tip, the proximal end portion defining a connecting member that removably connects the mixer to a torch head, and the mixer occludes the tip central gas passageway;

wherein the mixer defines a plurality of gas passageways including:

a mixer central gas passageway;

a plurality of proximal gas passageways extending from a proximal outer surface of the mixer to the mixer central gas passageway; and a plurality of distal gas passageways extending from the mixer central gas passageway to a distal end portion of the mixer.

2. The tip assembly according to claim 1, wherein the connecting member is selected from the group consisting of detents and threads.

3. The tip assembly according to claim 1, wherein the plurality of distal gas passageways extend at an angle between the mixer central gas passageway and the distal end portion of the mixer.

4. The tip assembly according to claim 1, wherein the plurality of proximal gas passageways extend radially between the proximal outer surface of the mixer and the mixer central gas passageway.

5. The tip assembly according to claim 1, wherein at least one of the distal gas passageways is adapted for fluid communication with an axial gas passageway of the tip for the flow of mixed gas from the mixer into the tip.

6. The tip assembly according to claim 1, wherein the mixer defines a distended length such that a length of the tip is reduced.

7. A gas torch comprising:

a torch head; and a tip assembly secured to the torch head, the tip assembly comprising:

a tip having an outer tip portion defining a central cavity and a distal orifice and an inner tip portion disposed within the central cavity of the outer tip portion, the inner tip portion defining an outer surface, a tip central gas passageway in communication with the distal orifice of the outer tip portion, and a plurality of intermediate gas passageways extending from the outer surface to the tip central gas passageway for a flow of at least one gas to provide improved cooling to the tip;

a mixer having a proximal end portion and a distal end portion, the distal end portion of the mixer being adapted for connection to the tip, and the proximal end portion defining a connecting member that removably connects the mixer to the torch head; and a locking ring for connecting the tip and the mixer to the torch head.

8. The gas torch according to claim 7 further comprising a spacer disposed between the locking ring and a proximal outer surface of the outer tip portion.

9. The gas torch according to claim 7, wherein the mixer occludes the tip central gas passageway.

10. The gas torch according to claim 7, wherein the connecting member is selected from the group consisting of detents and threads.

11. The gas torch according to claim 7, wherein the mixer defines a plurality of gas passageways including:

a mixer central gas passageway;

a plurality of proximal gas passageways extending radially from a proximal outer surface of the mixer to the mixer central gas passageway; and a plurality of distal gas passageways extending at an angle from the mixer central gas passageway to a distal end portion of the mixer.

12. A gas torch comprising:

a torch head; and a mixer having a proximal end portion and a distal end portion, the distal end portion of the mixer being adapted for connection to a tip, the proximal end portion defining a connecting member that removably connects the mixer to the torch head, and the mixer occludes a tip central gas passageway.

13. The gas torch according to claim 12, wherein the connecting member is selected from the group consisting of detents and threads.

14. The gas torch according to claim 12, wherein the mixer defines a distended length such that a length of the tip is reduced.

15. A tip assembly for use in a gas torch comprising:

a tip defining a proximal annular gas passageway, a distal annular gas passageway and an axial passageway, wherein the proximal and distal annular gas passageways are not in fluid communication and the distal annular gas passageway is in fluid communication with the axial passageway;

a mixer defining a central gas passageway and at least one proximal passageway in fluid communication with the central gas passageway, wherein the central gas passageway of the mixer is in fluid communication with the distal annular gas passageway through the axial passageway.

16. The tip assembly according to claim 15, wherein a fuel gas flows through the at least one proximal passageway of the mixer and is mixed with a preheat oxygen in the central gas passageway of the mixer.

17. The tip assembly according to claim 16, wherein a mixture of the fuel gas and the preheat oxygen is directed to the distal annular gas passageway of the tip through the at least one axial passageway.

18. The tip assembly according to claim 17, wherein the at least one axial passageway is offset from a central axis of the tip.

19. The tip assembly according to claim 15, wherein the tip defines a tip central gas passageway and at least one intermediate gas passageway in fluid communication with the tip central gas passageway and the proximal annular gas passageway.

20. The tip assembly according to claim 19, wherein a cutting oxygen is directed along an outer surface of the mixture and enters the tip central gas passageway through the proximal annular gas passageway and the at least one intermediate gas passageway.

21. The tip assembly according to claim 20, wherein the at least one intermediate passageway extends radially from an outer surface of the tip to the tip central gas passageway.

22. The tip assembly according to claim 15, wherein the mixer further includes a plurality of distal passageways in fluid communication with the central gas passageway of the mixer and the axial gas passageway of the tip.

* * * * *